US008197262B2

(12) United States Patent
Nguyen et al.

(10) Patent No.: US 8,197,262 B2
(45) Date of Patent: Jun. 12, 2012

(54) ELECTRICAL CONTACT FOR AN ELECTRICAL CONNECTOR MOUNTED ON A PRINTED CIRCUIT

(75) Inventors: Hung Thai Nguyen, Harrisburg, PA (US); Matthew R. McAlonis, Elizabethtown, PA (US); Kenneth Paul Dowhower, Harrisburg, PA (US); Dustin Carson Belack, Hummelstown, PA (US); George Harold Douty, Mifflintown, PA (US)

(73) Assignee: Tyco Electronic Corporation, Berwyn, PA (US)

( * ) Notice: Subject to any disclaimer, the term of this patent is extended or adjusted under 35 U.S.C. 154(b) by 0 days.

(21) Appl. No.: 12/732,972

(22) Filed: Mar. 26, 2010

(65) Prior Publication Data

US 2011/0237137 A1 Sep. 29, 2011

(51) Int. Cl.
*H01R 12/00* (2006.01)

(52) U.S. Cl. ..... 439/74

(58) Field of Classification Search ..... 439/74, 439/78, 83

See application file for complete search history.

(56) References Cited

U.S. PATENT DOCUMENTS 4,597,625 A * 7/1986 Seidler ..... 439/682
4,693,528 A * 9/1987 Asick et al. ..... 439/83
6,004,169 A 12/1999 Wu
6,227,882 B1 5/2001 Ortega et al.
7,497,700 B2 * 3/2009 Chen et al. ..... 439/78
7,744,431 B2 * 6/2010 Trout et al. ..... 439/733.1
7,771,244 B1 * 8/2010 Ju ..... 439/857
2003/0228809 A1 12/2003 Howell et al.
2005/0112959 A1 5/2005 Lai

FOREIGN PATENT DOCUMENTS

EP 0 561 202 9/1993
EP 1 241 735 9/2002

OTHER PUBLICATIONS

European Search Report, Mail Date Jun. 17, 2011, EP 11 15 9708, Application No. 11159708.4-1231.

* cited by examiner

*Primary Examiner* — Phuong Dinh

(57) ABSTRACT

An electrical contact is provided for an electrical connector that is mounted on a printed circuit. The electrical contact includes a mating segment having a mating interface configured to engage a mating contact of another connector. The electrical contact also includes a tail segment having a mounting interface configured to be mounted to the printed circuit. An intermediate segment extends between and interconnects the mating and tail segments. The intermediate segment includes a base wall extending a length from the tail segment to the mating segment. The intermediate segment further includes a side wall extending outwardly from the base wall along at least a portion of the length of the base wall. The side wall extends outwardly at a non-parallel angle relative to the base wall for affecting at least one of an impedance, an insertion loss, or a reflection of the electrical contact.

20 Claims, 11 Drawing Sheets

ELECTRICAL CONTACT FOR AN ELECTRICAL CONNECTOR MOUNTED ON A PRINTED CIRCUIT

BACKGROUND OF THE INVENTION

The subject matter described and/or illustrated herein relates generally to electrical connectors, and more particularly, to the electrical contacts of electrical connectors that are mounted on printed circuits.

Electrical connector systems are commonly used to interconnect electrical components together. For example, electrical connector systems are sometimes used to electrically connect two printed circuits (sometimes referred to as "circuit boards") together. To interconnect the printed circuits, an electrical connector on one of the printed circuits is mated with an electrical connector on the other printed circuit. As the electrical connectors are mated together, electrical contacts of the connectors engage each other to electrically connect the connectors, and thereby the printed circuits, together.

Some electrical connector systems are used to interconnect two printed circuits that extend parallel to each other. The printed circuits include mating sides that face each other and define a space therebetween. The electrical connectors are mounted on the mating sides of the printed circuits such that the electrical connector system extends between the printed circuits within the space therebetween. It is sometimes desirable to increase the amount of space between the printed circuits, for example to provide more space for electrical components or devices mounted on the mating sides of the printed circuits. A height of the electrical connector system must therefore be increased to bridge the increased amount of space between the printed circuits. In some circumstances, the electrical contacts of the electrical connector system may need to be lengthened to accommodate the overall increased height of the system. But, the increased height of the electrical connector system may make it difficult to maintain the electrical performance thereof. For example, the increased height of the electrical connector system may cause the electrical contacts to experience different impedance than an overall impedance of the system. Moreover, and for example, the increased height of the electrical connector system may cause the electrical contacts to experience more insertion loss, more signal reflection between adjacent electrical contacts, and/or the like.

BRIEF DESCRIPTION OF THE INVENTION

In one embodiment, an electrical contact is provided for an electrical connector that is mounted on a printed circuit. The electrical contact includes a mating segment having a mating interface configured to engage a mating contact of another connector. The electrical contact also includes a tail segment having a mounting interface configured to be mounted to the printed circuit. An intermediate segment extends between and interconnects the mating and tail segments. The intermediate segment includes a base wall extending a length from the tail segment to the mating segment. The intermediate segment further includes a side wall extending outwardly from the base wall along at least a portion of the length of the base wall. The side wall extends outwardly at a non-parallel angle relative to the base wall for affecting at least one of an impedance, an insertion loss, or a reflection of the electrical contact.

In another embodiment, an electrical connector is provided for mounting on a printed circuit. The electrical connector includes an electrical contact having a mating segment, an intermediate segment, and a tail segment. The mating segment is configured to engage a mating contact of a mating connector. The tail segment is configured to engage the printed circuit. The intermediate segment extends between and interconnects the mating and tail segments. The intermediate segment includes a base wall extending a length from the tail segment to the mating segment. The intermediate segment further includes a side wall extending outwardly from the base wall along at least a portion of the length of the base wall. The side wall extends outwardly at a non-parallel angle relative to the base wall for affecting at least one of an impedance, an insertion loss, or a reflection of the electrical contact. The electrical connector also includes a housing having a base and a shroud. The base includes a shroud side, a mounting side, and a contact opening. The mounting side of the base is configured to be mounted on the printed circuit. The intermediate segment of the electrical contact is held by the base within the contact opening such that the mating segment extends outward from the shroud side of the base. The shroud extends outwardly from the shroud side of the base and around the mating segment of the electrical contact.

DETAILED DESCRIPTION OF THE INVENTION

Figure 1:
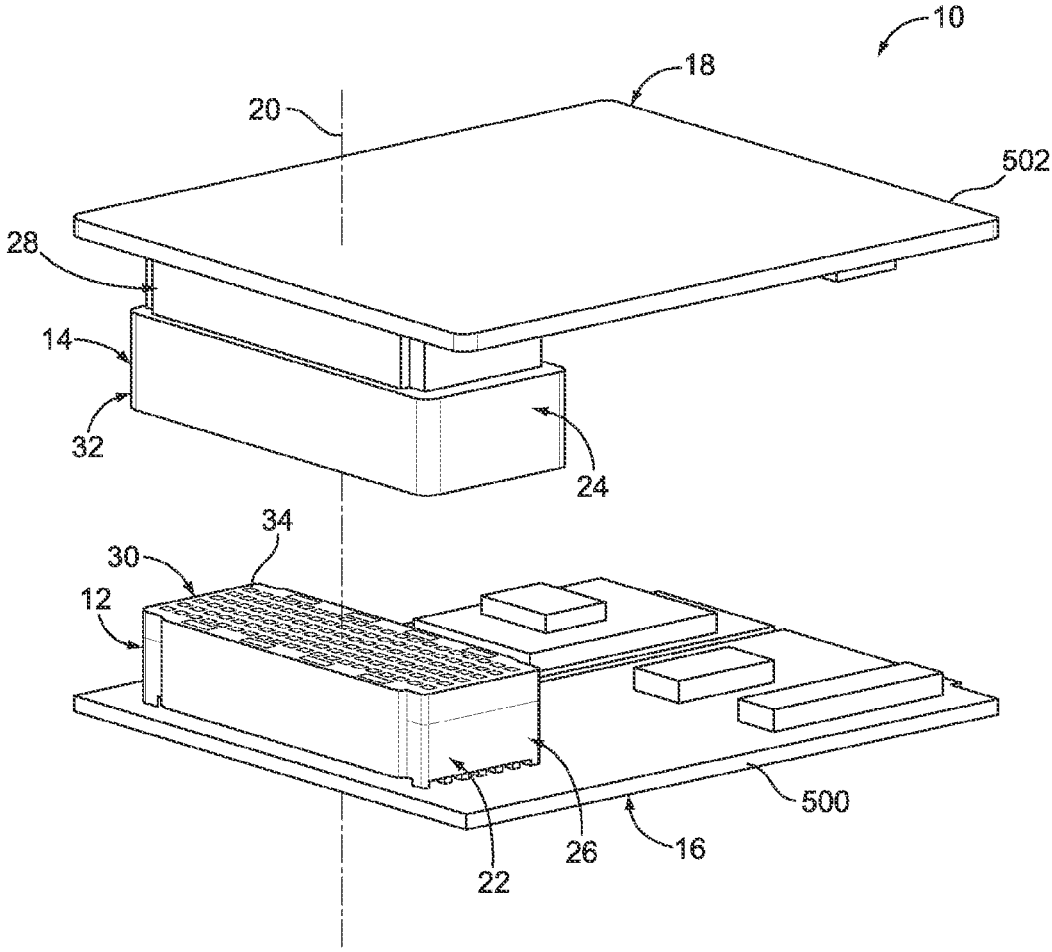
FIG. 1 is a perspective view of an exemplary embodiment of an electrical connector system illustrating a receptacle connector and a header connector of the system as unmated.

FIG. 1 is a perspective view of an exemplary embodiment of an electrical connector system 10. The electrical connector system 10 includes a receptacle connector 12, a header connector 14, a printed circuit 16, and a printed circuit 18. The connectors 12 and 14 are electrically connected to, and mounted on, the printed circuits 16 and 18, respectively. A mating axis 20 extends through both the receptacle connector 12 and the header connector 14. The connectors 12 and 14 can be mated together in a direction parallel to and along the mating axis 20. When mated, an electrical connection is established between the receptacle connector 12 and the header connector 14. An electrical connection is thereby established between the printed circuits 16 and 18 via the connectors 12 and 14 for transferring electrical power, electrical signals, and/or electrical ground between the printed circuits 16 and 18. The receptacle connector 12 and the header connector 14 may each be referred to herein as an "electrical connector" and/or as a "mating connector".

Optionally, either the receptacle connector 12 or the header connector 14 may be in a fixed position and only the other of the receptacle connector 12 and the header connector 14 is moved along the mating axis 20 to mate the connectors 12 and 14 together. For example, the receptacle connector 12 and the printed circuit 16 may be fixed within an electronic device (not shown) such as, but not limited to, a host device, a computer, a network switch, a computer server, and/or the like, while the header connector 14 may be part of an external device (not shown) being electrically connected to the electronic device, or vice versa.

In the exemplary embodiment, the printed circuits 16 and 18 extend parallel to each other in different planes when the connectors 12 and 14 are mated together. Alternatively, the printed circuits 16 and 18 have any other orientation, location, position, and/or the like relative to each other when the connectors 12 and 14 are mated together. For example, in some alternative embodiments, the printed circuits 16 and 18 extend orthogonally to each other when the connectors 12 and 14 are mated together. Moreover, and for example, in some alternative embodiments the printed circuits 16 and 18 extend coplanar to each other when the connectors 12 and 14 are mated together. In other words, in some alternative embodiments the printed circuits 16 and 18 extend approximately parallel to each other in generally the same plane, such that edges of the printed circuits 16 and 18 face each other.

The connectors 12 and 14 include respective housings 22 and 24. The housings 22 and 24 include respective bases 26 and 28 and respective shrouds 30 and 32. Electrical contacts 34 and 36 (FIG. 12) are held by the housings 22 and 24, respectively. When the connectors 12 and 14 are mated together, each electrical contact 34 of the receptacle connector 12 mates with a corresponding electrical contact 36 of the header connector 14 to electrically connect the connectors 12 and 14 together. Each of the electrical contacts 34 and 36 may be referred to herein as a "mating contact".

Figure 2:
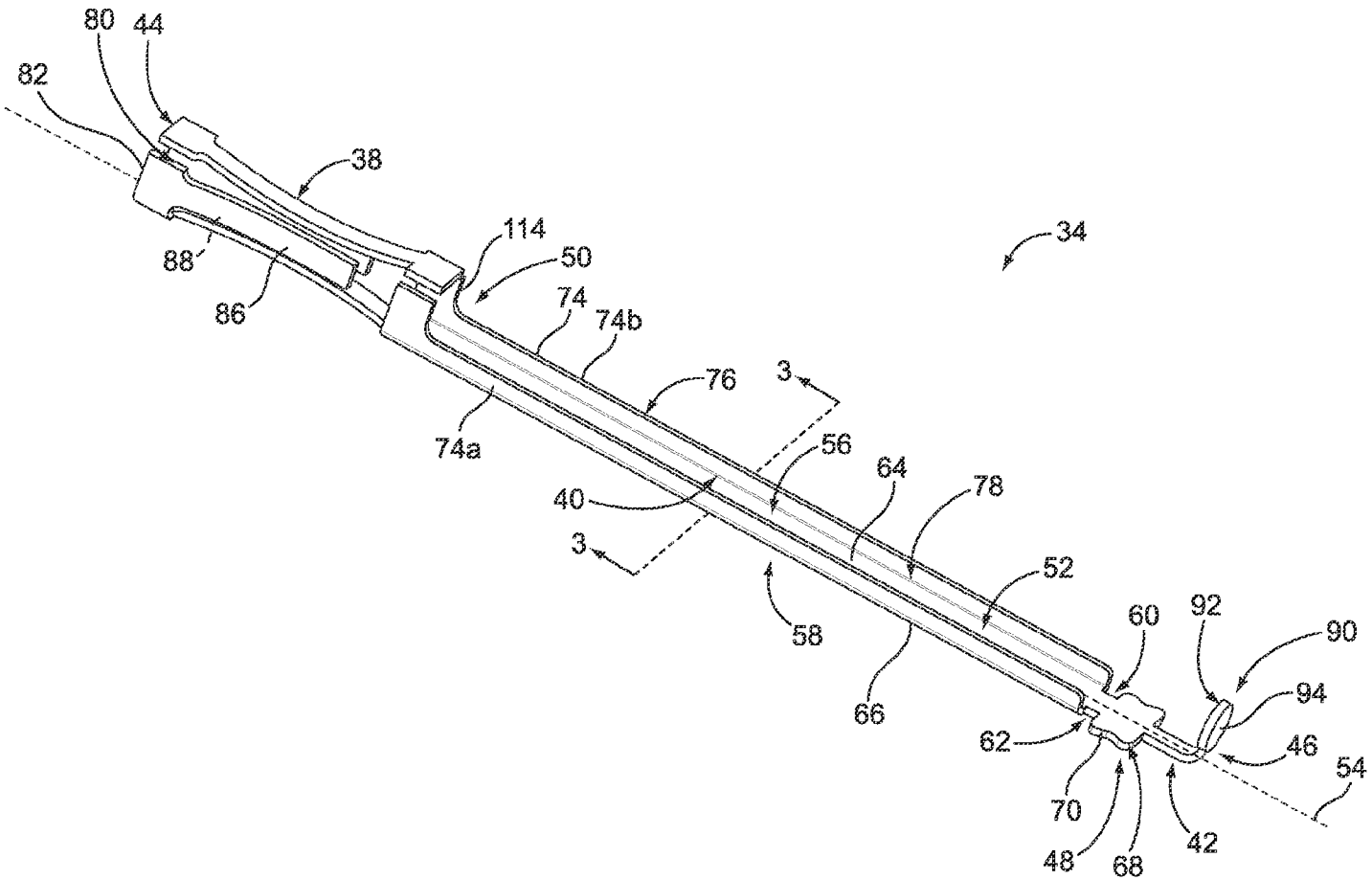
FIG. 2 is a perspective view of an exemplary embodiment of an electrical contact of the receptacle connector shown in FIG. 1.
Figure 10:
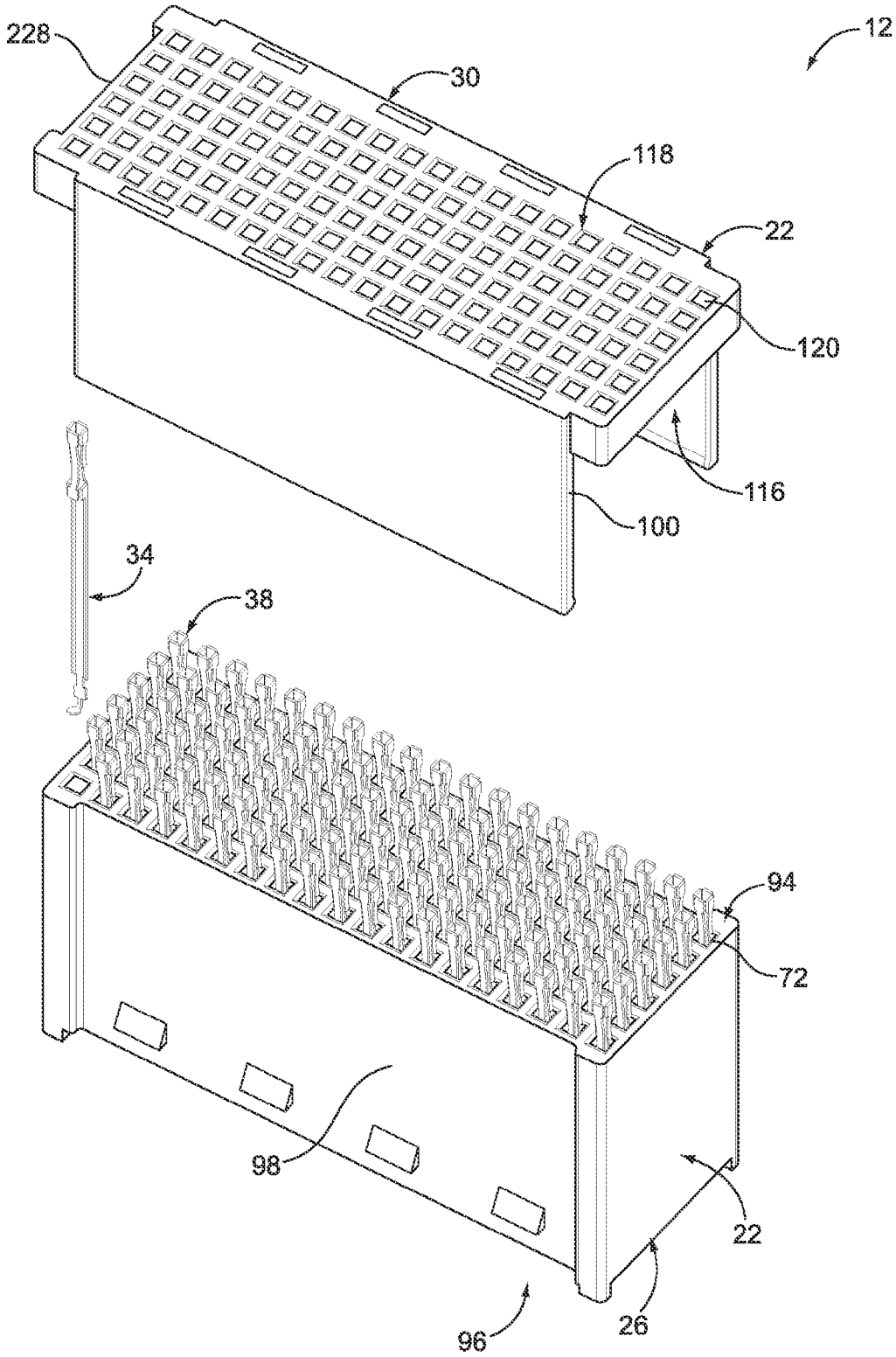
FIG. 10 is a partially exploded perspective view of an exemplary embodiment of the receptacle connector shown in FIG. 1.

FIG. 2 is a perspective view of an exemplary embodiment of one of the electrical contacts 34 of the receptacle connector 12 (FIGS. 1 and 10). The electrical contact 34 includes a mating segment 38, an intermediate segment 40, and a tail segment 42. The electrical contact 34 extends a length from an end 44 of the mating segment 38 to an end 46 of the tail segment 42. The intermediate segment 40 extends between, and interconnects, the mating and tail segments 38 and 42, respectively. Specifically, the intermediate segment 40 extends from an end 48 that is connected to the tail segment 42 to an end 50 that is connected to the mating segment 38.

The intermediate segment 40 includes a base wall 52 that extends a length along a central longitudinal axis 54 from the tail segment 42 to the mating segment 38. The base wall 52 includes a side 56 and a side 58 that is opposite the side 56. Each of the sides 56 and 58 extends a width between a pair of opposite edges 60 and 62 of the base wall 52. Each side 56 and 58 of the base wall 52 includes a respective surface 64 and 66. In the exemplary embodiment, the surfaces 64 and 66 are each approximately planar along an approximate entirety of the length of the base wall 52. Accordingly, each of the sides 56 and 58 of the base wall 52 is approximately planar along an approximate entirety of the length of the base wall 52. However, the surface 64 and/or the surface 66 may be non-planar along at least a portion of the length of the base wall 52 such that the sides 56 and/or 58 are non-planar along at least a portion of the length of the base wall 52.

Optional retention tabs 68 are provided on the intermediate segment 40 of the electrical contact 34. The retention tabs 68 cooperate with the housing base 26 (FIGS. 1, 10, and 11) for holding the electrical contact 34 to the base 26. In the exemplary embodiment, the retention tabs 68 extend outwardly from the edges 60 and 62 of base wall 52. Specifically, one retention tab 68 extends outwardly from the edge 60 of the base wall 52 and another retention tab 68 extends outwardly from the edge 62. Each retention tab 68 includes a tip 70 that, as will be described below, is configured to engage the housing base 26 within a corresponding contact opening 72 (FIGS. 10 and 11) of the base 26 to hold the electrical contact 34 to the base 26 within the contact opening 72. In addition or alternative to the retention tabs 68, the electrical contact 34 may include any other structure for holding the electrical contact 34 to the base 26 within the contact opening 72. The electrical contact 34 may include any number of the retention tabs 68.

Figure 3:
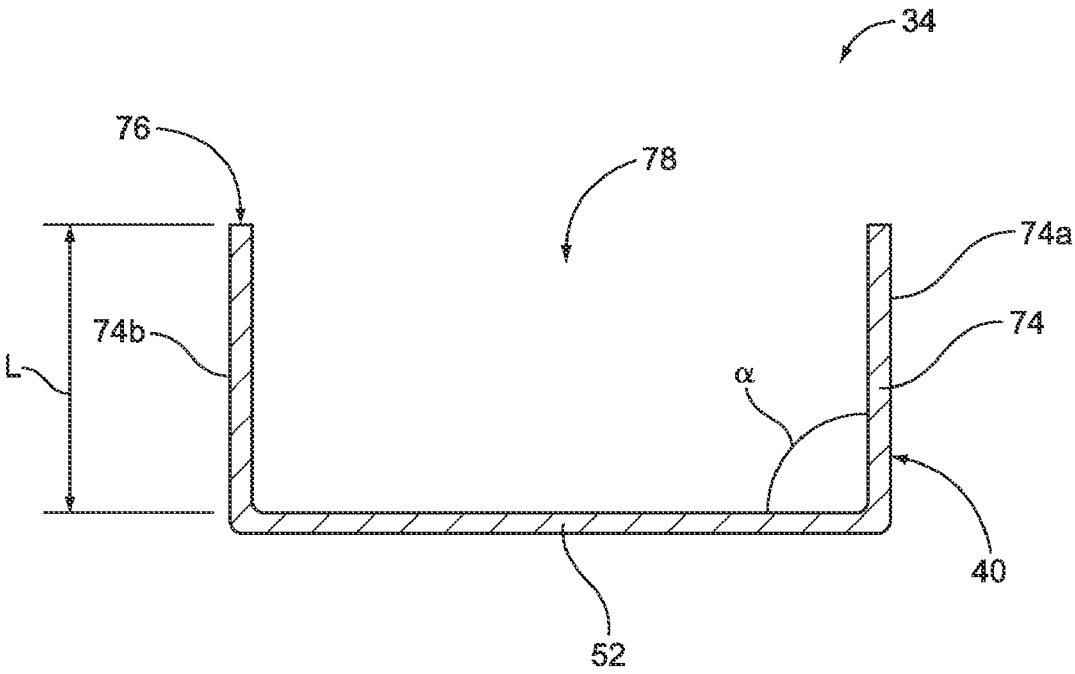
FIG. 3 is a cross sectional view of the electrical contact shown in FIG. 2 taken along line 3-3 of FIG. 2.

FIG. 3 is a cross-sectional view of the electrical contact 34 taken along line 3-3 of FIG. 2. The cross section of FIG. 3 is taken perpendicular to the length of the base wall 52. Referring now to FIGS. 2 and 3, the intermediate segment 40 includes one or more sidewalls 74 that extend outwardly from the base wall 52. The configuration of the side walls 74 of the electrical contact 34 may be selected to facilitate providing the electrical contacts 34 of the receptacle connector 12 with a predetermined electrical performance. For example, the configuration of the side walls 74 affects an impedance between the electrical contact 34 and adjacent electrical contacts 34 within the receptacle connector 12 (FIGS. 1 and 10). In some embodiments, the side walls 74 are configured to provide a similar or matching impedance between electrical contacts 34 that are adjacent one another within the receptacle connector 12.

The impedance between adjacent electrical contacts 34 within the receptacle connector 12 is determined by the length of the side walls 74 relative to the base wall 52 and the angle of the side walls 74 relative to the base wall 52. Specifically, longer side walls 74 provide a higher capacitance, and therefore lower impedance, between adjacent electrical contacts 34. Shorter side walls 74 provide less capacitance, and thus higher impedance, between adjacent electrical contacts 34. The angle of a given side wall 74 relative to the base wall 52 affects the impedance because the angle determines how far apart a given side wall 74 is from an adjacent side wall 74 of an adjacent electrical contact 34. A greater distance between a given side wall 74 and an adjacent side wall 74 of an adjacent electrical contact 34 provides a lower capacitance and higher impedance between the adjacent electrical contacts 34. A smaller distance between a given side wall 74 and an adjacent side wall 74 of an adjacent electrical contact 34 provides higher capacitance and lower impedance between the adjacent electrical contacts 34.

Figure 4:
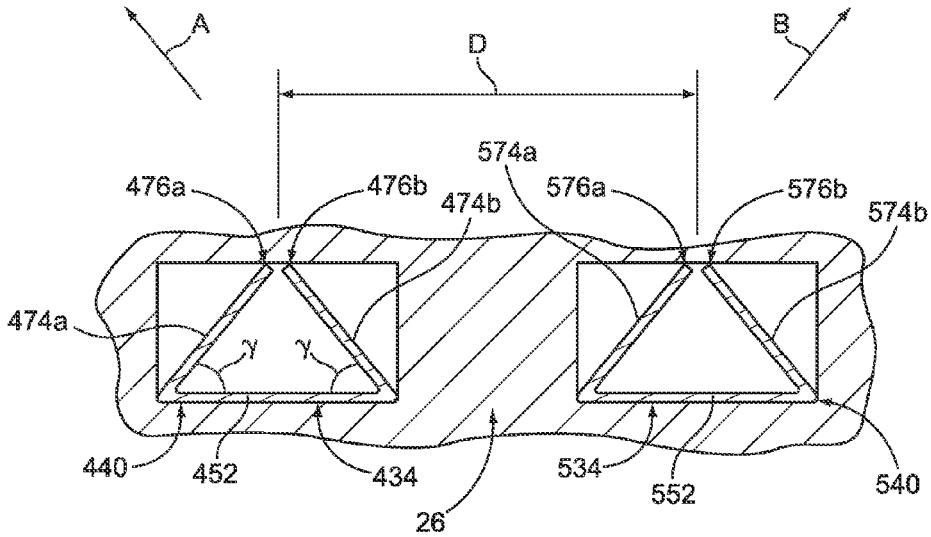
FIG. 4 is a cross-sectional view illustrating an exemplary embodiment of two alternative electrical contacts that are adjacent one another within the receptacle connector shown in FIG. 1.

For example, a smaller angle between a given side wall 74 and the base wall 52 causes a distance between the given side wall 74 and an adjacent side wall 74 of an adjacent electrical contact 34 to increase. Specifically, a side wall 74 that is angled acutely with respect to the base wall 52 extends outwardly from the base wall 52 in a direction that is generally away from an adjacent side wall 74 of an adjacent electrical contact 34. FIG. 4 is a cross-sectional view illustrating an exemplary embodiment of two alternative electrical contacts 434 and 534 that are held by the base 26 adjacent one another. The electrical contacts 434 and 534 include respective intermediate segments 440 and 540. The intermediate segments 440 and 540 include respective base walls 452 and 552. The electrical contact 434 includes two sidewalls 474*a* and 474*b* that extend outwardly from the base wall 452 to respective free ends 476*a* and 476*b*. Each of the side walls 474*a* and 474*b* extends at an acute angle γ with respect to the base wall 452. Two side walls 574*a* and 574*b* extend outwardly from the base wall 552 of the electrical contact 534 to respective free ends 576*a* and 576*b*. The side walls 474*b* and 574*a* of the electrical contacts 434 and 534, respectively, extend in respective directions A and B that extend generally away from each other. The free end 476*b* of the side wall 474*b* is spaced a distance D from the free end 576*a* of the side wall 574*a*. The free end 476*b* is spaced further apart from the free end 576*a* than if one or both of the side walls 474*b* and 574*a* extended at a perpendicular or obtuse angle with respect to the base wall 452 and 552, respectively.

Figure 5:
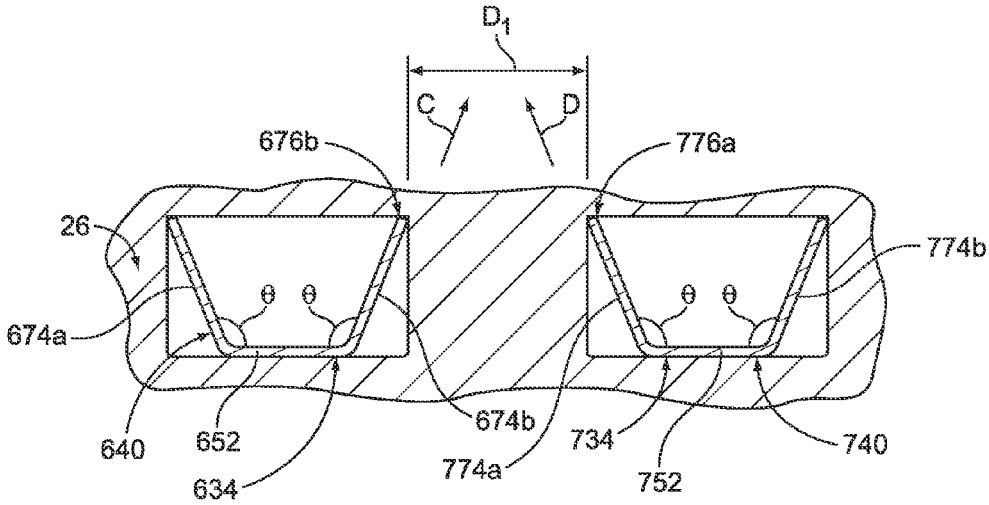
FIG. 5 is cross-sectional view illustrating another exemplary embodiment of two alternative electrical contacts that are adjacent one another within the receptacle connector shown in FIG. 1.

FIG. 5 is a cross-sectional view illustrating an exemplary embodiment of two alternative electrical contacts 634 and 734 that are held by the base 26 adjacent one another. The electrical contacts 634 and 734 include respective intermediate segments 640 and 740, which include respective base walls 652 and 752. The intermediate segment 640 of the electrical contact 634 includes two side walls 674*a* and 674*b* that extend at obtuse angles θ with respect to the base wall 652. Two side walls 774*a* and 774*b* also extend outwardly from the base wall 752 of the electrical contact 734 at obtuse angles θ with respect to the base wall 752. The side walls 674*b* and 774*a* of the electrical contacts 634 and 734, respectively, extend in respective directions C and D that extend generally toward each other. Free ends 676*b* and 776*a* of the side walls 674*b* and 774*a*, respectively, are spaced a distance $D_1$ apart from each other. As can be seen from a comparison of FIGS. 4 and 5, the distance D between the free ends 476*b* and 576*a* of the side walls 474*b* and 574*a* is larger than the distance $D_1$ between the free ends 676*b* and 776*a* of the side walls 674*b* and 774*a*. Accordingly, the smaller distance $D_1$ between the free ends 676*b* and 776*a* of the side walls 674*b* and 774*a* provides a higher capacitance and lower impedance between the electrical contacts 634 and 734 as compared to the capacitance and impedance between the electrical contacts 434 and 534.

Referring again to FIGS. 2 and 3, the configuration of the side walls 74 also effects an impedance between the electrical contact 34 and other components of the system 10 (FIG. 1), such as, but not limited to, components of the printed circuits 16 and 18 and/or the like. The impedance between the electrical contact 34 and other components of the system 10 is determined by the shape of the intermediate segment 40 of the electrical contact 34 relative to the mating and mounting segments 38 and 42, respectively. Specifically, a shape of the intermediate segment 40 that more closely matches the shapes of the mating segment 38 and the mounting segment 42 provides the electrical contact 34 with a more uniform shape along the length thereof. The more uniform shape provides less electrical discontinuity along the length of the electrical contact 34, which results in less electrical reflection between the electrical contact 34 and other components of the system 10. In some embodiments, the side walls 74 are configured to provide a similar or matching impedance between the electrical contact 34 and other components of the system 10.

The configuration of the side walls 74 also affects an insertion loss experienced by the electrical contact 34. The amount of insertion loss experienced by the electrical contact 34 is determined by the surface area of the electrical contact 34. A greater surface area provides less insertion loss. Longer side walls 74 increase the surface area of the intermediate segment 40 of the electrical contact 34, resulting in a lower insertion loss. Shorter side walls 74 decrease the surface area of the intermediate segment 40, which provides the electrical contact 34 with a higher insertion loss. The configuration of the side walls 74 may be selected to minimize the insertion loss of the electrical contact 34.

The shape of the intermediate segment 40 of the electrical contact 34 relative to the mating and mounting segments 38 and 42, respectively, also affects the amount of signal reflection. Electrical discontinuity along the length of the electrical contact 34 results in more signal reflection between adjacent electrical contacts 34 within the receptacle connector 12. Providing the electrical contact 34 with a more uniform shape along the length thereof decreases the amount of electrical discontinuity along the length of the electrical contact 34. Decreasing the amount of electrical discontinuity along the length of a given electrical contact 34 may result in less signal reflection between the given electrical contact 34 and an adjacent electrical contact 34 within the receptacle connector 12. The configuration of the side walls 74 may be selected to minimize the amount of signal reflection between adjacent electrical contacts 34 within the receptacle connector 12.

In the exemplary embodiment of the electrical contact 34, the intermediate segment 40 includes two side walls 74 that extend outwardly from a corresponding one of the edges 60 and 62 of the base wall 52. Specifically, a sidewall 74*a* extends outwardly from the edge 60 of the base wall 52, and a sidewall 74*b* extends outwardly from the edge 62. Each of the side walls 74*a* and 74*b* extends a length L (not labeled in FIG. 2) outwardly from the respective edge 60 and 62 of the base wall 52 to a free end 76. In the exemplary embodiment of the electrical contact 34, the length L of each of the side walls 74*a* and 74*b* is approximately half of the width of the base wall 52. The length L of the side walls 74*a* and 74*b* is selected to provide a predetermined impedance between the electrical contact 34 and adjacent electrical contacts 34 of the receptacle connector 12. The length L and number of the side walls 74*a* and 74*b* is selected to provide the intermediate segment 40 with a surface area causes the electrical contact 34 to experience a predetermined insertion loss.

Because the side walls 74*a* and 74*b* are spaced apart from each other along the width of the base wall 52, the side walls 74*a* and 74*b* define a channel 78 between the side wall 74*a*, the side wall 74*b*, and base wall 52. The side walls 74*a* and 74*b* define side boundaries of the channel 78, while the base wall 52 defines a bottom boundary of the channel 78. In the exemplary embodiment of the electrical contact 34, each of the sidewalls 74*a* and 74*b* extends outwardly from the base wall 52 at an approximately perpendicular angle α (not shown in FIG. 2) relative to the base wall 52. Accordingly, the channel 78 has an approximately "U" shaped cross-sectional shape.

The perpendicular angle α of the side walls 74*a* and 74*b* relative to the base wall 52 provides a predetermined distance between the side walls 74*a* and 74*b* and the side walls 74 of adjacent electrical contacts 34. For example, the perpendicular angle α of the side walls 74*a* and 74*b* relative to the base wall 52 provides a predetermined distance between the free ends 76 of the side walls 74*a* and 74*b* and the side walls 74 of adjacent electrical contacts 34. The predetermined distance between the side walls 74*a* and 74*b* of the electrical contact 34 and the side walls 74 of adjacent electrical contacts 34 provides a predetermined amount of impedance and a predetermined amount of signal reflection between the electrical contact 34 and the adjacent electrical contacts 34. The approximate U shaped channel 78 provides the intermediate segment 40 with a shape that more closely matches the shapes of the mating segment 38 and/or the mounting segment 42 as compared to an intermediate segment 40 that does not include the side walls 74*a* and 74*b*. For example, the U shaped channel 78 more closely matches the shape of a socket 82 of the mating segment 38. The more uniform shape of the electrical contact 34 also provides a predetermined amount of signal reflection between the electrical contact 34 and adjacent electrical contacts 34 of the receptacle connector 12.

Referring now to FIG. 2, each of the side walls 74*a* and 74*b* extends along a majority of the length of the base wall 52. However, each of the side walls 74*a* and 74*b* may extend along any amount, location, and/or portion of the length of the base wall 52. In some alternative embodiments, the side wall 74*a* and/or 74*b* may extend along an approximate entirety of the length of the base wall 52 from the mating segment 38 to the tail segment 42. Moreover, in some alternative embodiments, one or both of the side walls 74*a* and 74*b* is segmented along the length of the base wall 52. Each side wall 74*a* and 74*b* may extend from any location along the width of the base wall 52 in alternative to the respective edge 60 and/or 62. Although shown as extending along an approximately straight path from the mating segment 38 to the tail segment 42, the intermediate segment 40 may alternatively extend along a non-linear path (e.g., a curved path, bent path, and/or the like) from the mating segment 38 to the tail segment 40.

Figure 6:
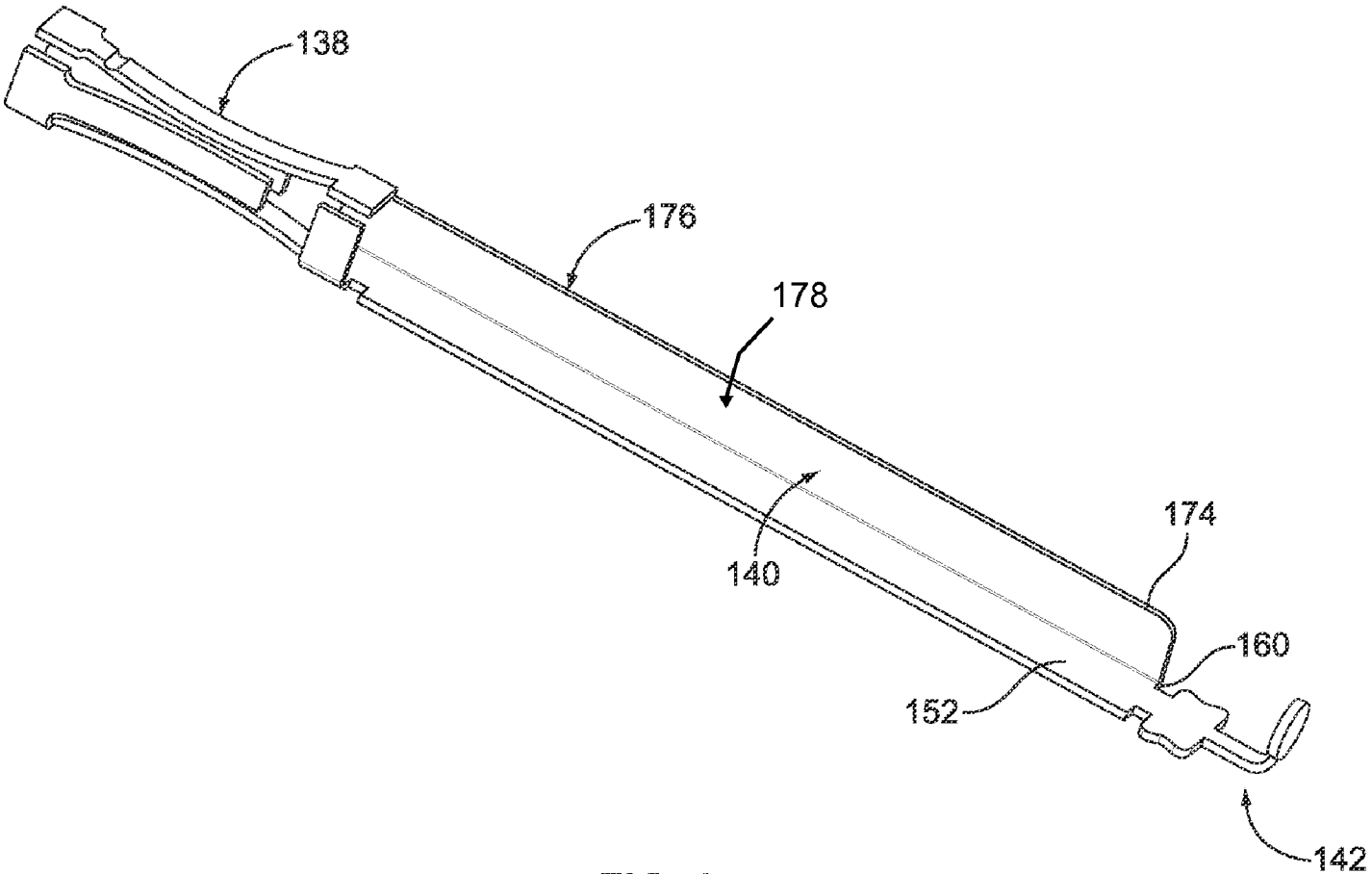
FIG. 6 is a perspective view of an exemplary alternative embodiment of an electrical contact of the receptacle connector shown in FIG. 1.

The electrical contact 34 is not limited to having two side walls 74. Rather, the electrical contact 34 may include any number of side walls 74. For example, FIG. 6 is a perspective view of an exemplary alternative embodiment of an electrical contact 134 of the receptacle connector 12. The electrical contact 134 is similar to the electrical contact 34 (FIGS. 1-3 and 10) except that the electrical contact 134 includes only a single side wall 174. The electrical contact 134 includes a mating segment 138, an intermediate segment 140, and a tail segment 142. The intermediate segment 140 extends between, and interconnects, the mating and tail segments 138 and 142, respectively.

The intermediate segment 140 includes a base wall 152 and the single side wall 174, which extends outwardly from an edge 160 of the base wall 152. The side walls 174 extends a length outwardly from the edge 160 of the base wall 152 to a free end 176. A channel 178 is defined between the side wall 174 and the base wall 152. The side wall 174 defines a side boundary of the channel 178, while the base wall 152 defines a bottom boundary of the channel 178. The sidewall 174 extends outwardly from the base wall 152 at an approximately perpendicular angle relative to the base wall 152. For example, the channel 178 has an approximately "L" shaped cross-sectional shape.

Figure 7:
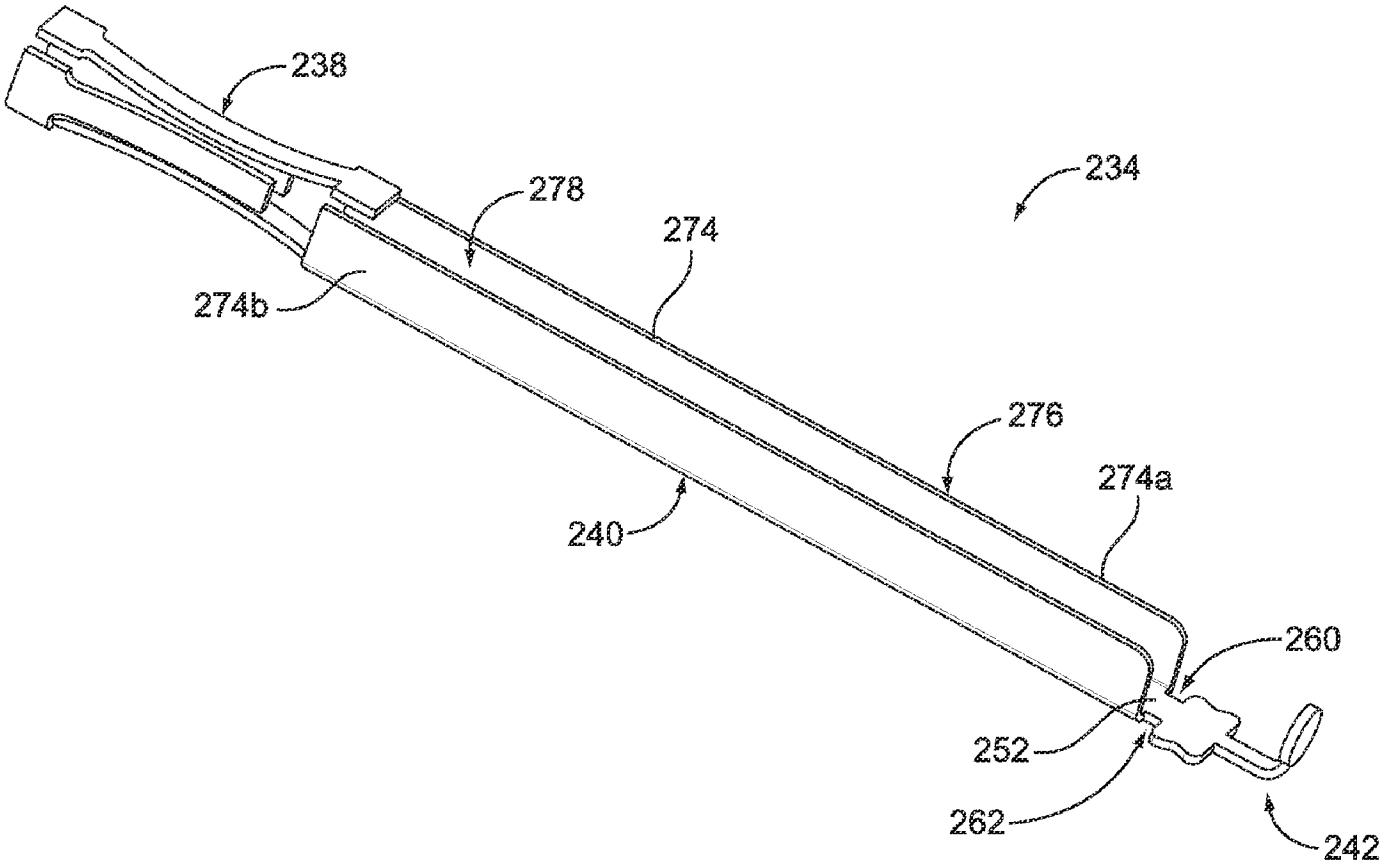
FIG. 7 is a perspective view of another exemplary alternative embodiment of an electrical contact of the receptacle connector shown in FIG. 1.

Referring again to FIG. 2, as discussed above, the length of each of the side walls 74*a* and 74*b* is approximately half of the width of the base wall 52. However, each side wall 74*a* and 74*b* of the electrical contact 34 may have any length relative to the width of the base wall 52. For example, FIG. 7 is a perspective view of an exemplary alternative embodiment of an electrical contact 234 of the receptacle connector 12. The electrical contact 234 is similar to the electrical contact 34 (FIGS. 1-3 and 10) except that the electrical contact 234 includes side walls 274 having lengths that are approximately equal to a width of a base wall 252. The electrical contact 234 includes a mating segment 238, an intermediate segment 240, and a tail segment 242. The intermediate segment 240 extends between, and interconnects, the mating and tail segments 238 and 242, respectively. The intermediate segment 240 includes the base wall 252 and two side walls 274*a* and 274*b*. The side walls 274*a* and 274*b* extend outwardly from respective edges 260 and 262 of the base wall 252. A channel 278 is defined between the side wall 274*a*, the side wall 274*b*, and the base wall 252.

Each of the side walls 274*a* and 274*b* extends a length outwardly from the respective edge 260 and 262 of the base wall 252 to a free end 276. The length of each of the side walls 274*a* and 274*b* is approximately equal to the width of the base wall 252. The greater lengths of the side walls 274*a* and 274*b* as compared to the side walls 74*a* and 74*b* of the electrical contact 34 (FIGS. 1-3 and 10) provides a higher capacitance, and thus a lower impedance, between adjacent electrical contacts 234 than between adjacent electrical contacts 34. Moreover, the longer side walls 274*a* and 274*b* provide a channel 278 with a shape that more closely matches the shape of the mating segment 238 as compared to the relative shapes between the channel 78 (FIGS. 2 and 3) and the mating segment 38 (FIGS. 2 and 9) of the electrical contact 34. The longer side walls 274*a* and 274*b* may provide the intermediate segment 240 with a greater mechanical stability than the intermediate segment 40 (FIGS. 2 and 3) of the electrical contact 34.

Figure 8:
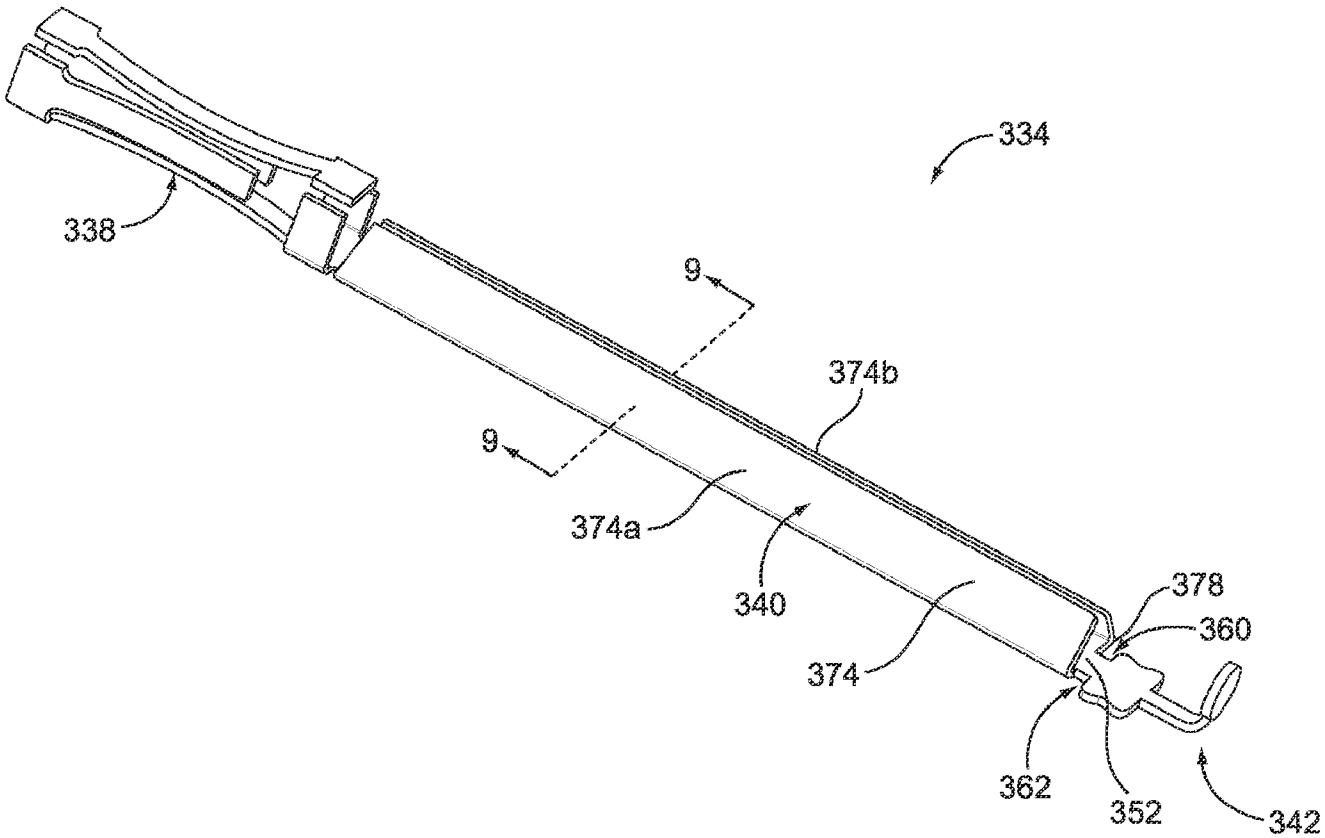
FIG. 8 is a perspective view of yet another exemplary alternative embodiment of an electrical contact of the receptacle connector shown in FIG. 1.
Figure 9:
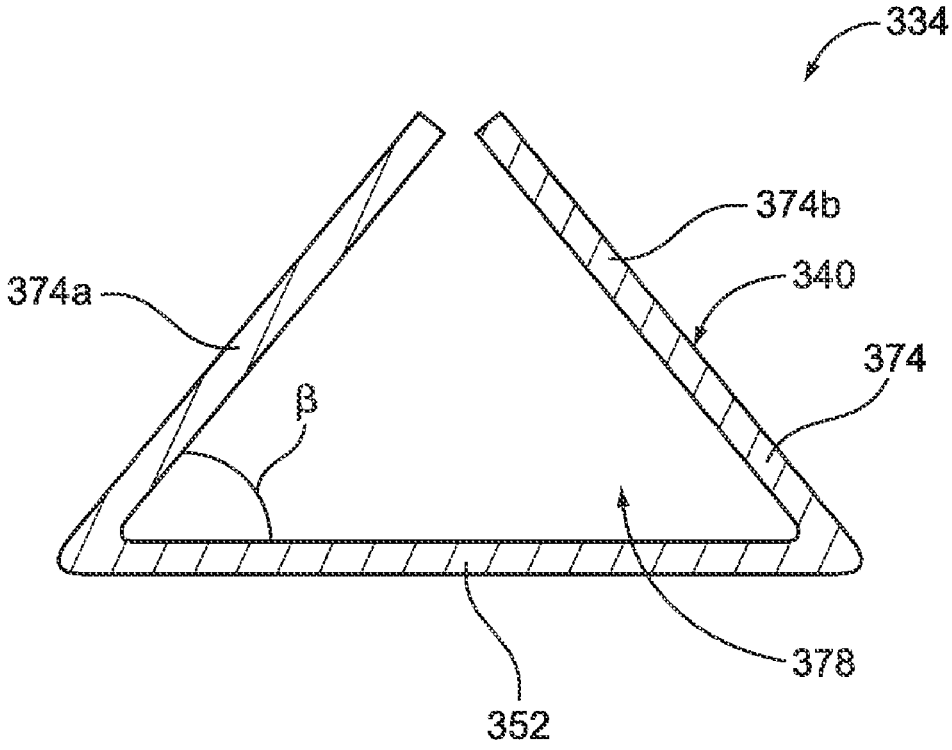
FIG. 9 is a cross sectional view of the electrical contact shown in FIG. 8 taken along line 9-9 of FIG. 8.

Although each of the side walls 74, 174, and 274 of the respective electrical contacts 34, 134, and 234 extends at an approximately perpendicular angle relative to the respective base wall 52, 152, and 252, each side wall 74, 174, and 274 may alternatively extend at any other non-parallel angle relative to the respective base wall 52, 152, and 252. The angles of the side walls relative to the base wall may define a channel having any cross-sectional shape. For example, FIG. 8 is a perspective view of another exemplary alternative embodiment of an electrical contact 334 of the receptacle connector 12. FIG. 9 is a cross sectional view of the electrical contact 334 taken along line 9-9 of FIG. 8. Referring now to FIGS. 8 and 9, the electrical contact 334 includes a mating segment 338 (not shown in FIG. 9), an intermediate segment 340, and a tail segment 342 (not shown in FIG. 9). The intermediate segment 340 extends between, and interconnects, the mating and tail segments 338 and 342, respectively. The intermediate segment 340 includes a base wall 352 and two side walls 374*a* and 374*b* that extend outwardly from respective edges 360 and 362 of the base wall 352.

A channel 378 is defined between the side wall 374*a*, the side wall 374*b*, and base wall 352. Each of the sidewalls 374*a* and 374*b* extends outwardly from the base wall 352 at an oblique angle β (not shown in FIG. 8) relative to the base wall 352 and in directions generally toward each other. Specifically, the angle β is an acute angle that, in the exemplary embodiment of the electrical contact 334, is approximately 45°. Accordingly, the channel 378 has an approximately triangular shaped cross-sectional shape. The exemplary triangular shaped cross section is that of an equilateral triangle because of the approximate 45° angle of the side walls 374 relative to the base wall 352. However, the channel 378 may have the cross-sectional shape of any other type of triangle, such as, but not limited to, an isosceles triangle, a right triangle, and/or the like. The side walls 374*a* and/or 374*b* may facilitate matching an impedance of the electrical contact 334 to an overall impedance of the electrical connector system 10, may facilitate reducing signal reflection between the electrical contact 334 and adjacent electrical contacts of the receptacle connector 12, and/or the like.

The 45° angle between the side walls 374 and the base wall 352 provides a greater amount of space between the side walls 374 of the electrical contact 334 and the side walls 374 of adjacent electrical contacts 334 as compared to the to distance between the side walls 74 of adjacent electrical contacts 34 (FIGS. 1-3 and 10). The greater distance between the sidewalls 374 of adjacent electrical contacts 334 provides a higher impedance between adjacent electrical contacts 334.

Referring again to FIG. 2, the mating segment 38 of the electrical contact 34 includes a mating interface 80. The mating segment 38 is configured to engage a corresponding one of the electrical contacts 36 (FIG. 12) of the header connector 14 (FIGS. 1 and 12) at the mating interface 80. In the exemplary embodiment of the electrical contact 34, the mating interface 80 is a socket 82 that engageably receives a pin 84 (FIG. 12) of the corresponding electrical contact 36 therein when the connectors 12 and 14 are mated together. The socket 82 is defined by a plurality of deflectable spring arms 86. An interior surface 88 of each of the spring arms 86 engages the corresponding pin 84 to establish an electrical connection between the corresponding electrical contacts 34 and 36. Alternatively, the mating segment 38 of one or more of the electrical contacts 34 includes any other structure for mating with the corresponding electrical contact 36, such as, but not limited to, a pin, a plug, an arm, and/or the like.

The tail segment 42 of the electrical contact 34 includes a mounting interface 90. The tail segment 42 is configured to be mounted to the printed circuit 16 (FIG. 1) at the mounting interface 90. The exemplary embodiment of the mounting interface 90 is a surface mount pad 92 that mounts on an exterior side of the printed circuit 16. The surface-mount pad 92 is defined by an approximately planar side 94 that engages a corresponding conductor (not shown) on a surface of exterior side of the printed circuit 16. Alternatively, the tail segment 42 of one or more of the electrical contacts 34 includes any other structure for mounting to the printed circuit 16, such as, but not limited to, a solder tail, a compliant pin that is received within an electrically conductive via (not shown) of the printed circuit 16, and/or the like.

FIG. 10 is a partially exploded perspective view of an exemplary embodiment of the receptacle connector 12. The receptacle connector 12 includes the housing 22 and the electrical contacts 34. The housing 22 includes the base 26 and the shroud 30. The base 26 has a shroud side 94 and an opposite mounting side 96. The mounting side 96 of the base 26 is configured to be mounted on the printed circuit 16 (FIG. 1). The shroud 30 is mounted on the base 26 such that the shroud 30 extends outwardly from the shroud side 94 of the base 26. The base 26 includes latch tabs 98 that cooperate with latch arms 100 of the shroud 30 to hold the shroud 30 on the base 26.

The base 26 includes the plurality of contact openings 72 for holding the electrical contacts 34. The contact openings 72 extend through the shroud side 94, through the mounting side 96, and completely through the base 26 therebetween. Each contact opening 72 holds an electrical contact 34 of the receptacle connector 12. The base 26 may include any number of contact openings 72 for holding any number of electrical contacts 34.

Figure 11:
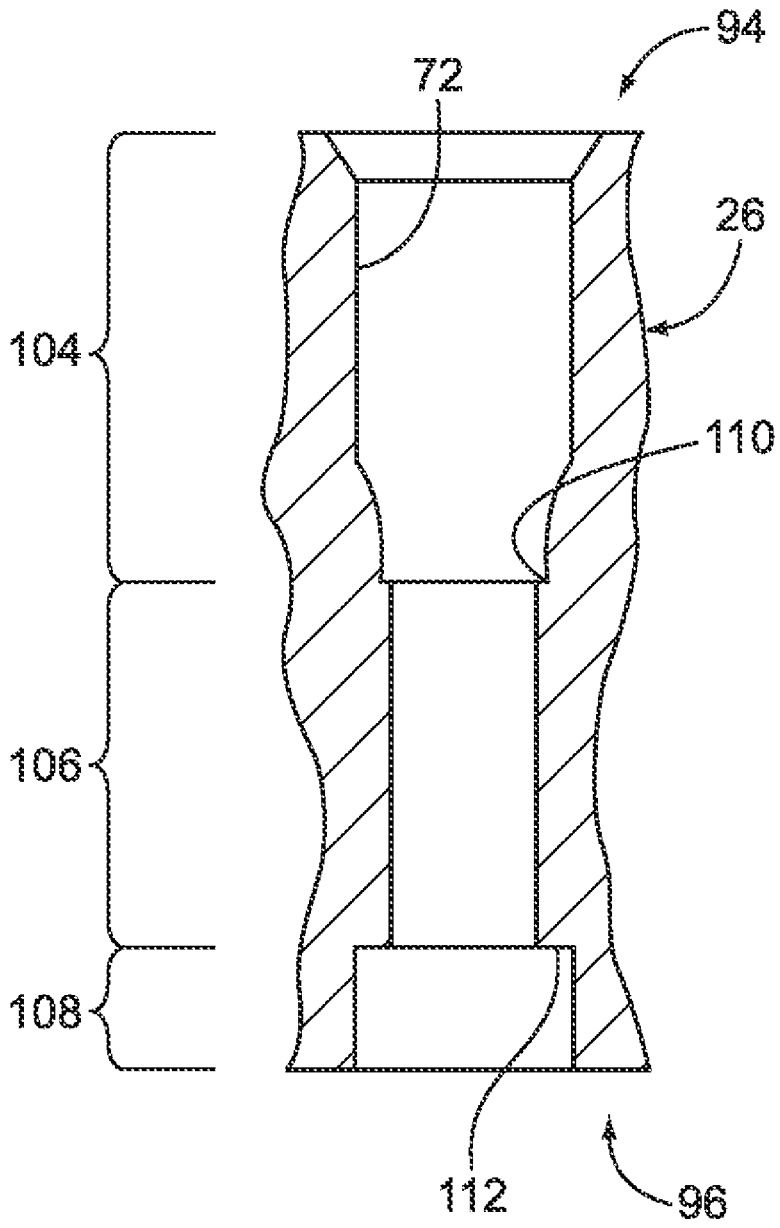
FIG. 11 is a cross-sectional view of a portion of an exemplary embodiment of a base of the receptacle connector shown in FIG. 10 illustrating an exemplary embodiment of a contact opening.

FIG. 11 is a portion of a cross-sectional view of a portion of the base 26 illustrating an exemplary embodiment of one of the contact openings 72. The contact opening 72 extends through the base 26 and includes a shroud side segment 104, an intermediate segment 106, and a mounting side segment 108. The shroud side segment 104 extends into the base 26 through the shroud side 94 and toward the mounting side 96. The mounting side segment 108 extends into the base 26 through the mounting side 96 and toward the shroud side 94. The intermediate segment 106 of the contact opening 72 extends between, and fluidly connects, the shroud side segment 104 and the mounting side segment 108.

The shroud side segment 104 extends a depth to a ledge 110. Adjacent the ledge 110, the shroud side segment 104 of the contact opening 72 optionally tapers to a narrower width. The mounting side segment 108 extends a depth to a ledge 112. In the exemplary embodiment, the shroud side, intermediate, and mounting side segments 104, 106, and 108, respectively, have rectangular cross-sectional shapes. But, the segments 104, 106, and 108 of each contact opening 72 may each include any other shape.

When the contact opening 72 holds an electrical contact 34 (FIGS. 1-3 and 10) of the receptacle connector 12, the ledge 110 is configured to engage one or more flanges 114 (FIG. 2) of the mating segment 38 of the electrical contact 34 to facilitate preventing the electrical contact 34 from being inadvertently removed from the contact opening 72 through the mounting side 96. The intermediate segment 106 of the contact opening 72 holds the intermediate segment 40 of the corresponding electrical contacts 34 therein. The optional retention tabs 68 of the electrical contact 34 engage the base 26 within the intermediate segment 106 of the contact opening 72 to hold the electrical contact 34 within the contact opening 72. When held in the contact openings 72, the mating segments 38 (FIGS. 2 and 10) of the electrical contacts 34 extend outward from the shroud side 94 of the base 26, while the tail segments 42 (FIG. 2) extend outward from the mounting side 96 of the base 26 for engagement with the printed circuit 16 (FIG. 1).

Referring again to FIG. 10, the shroud 30 includes a base side 116 and an opposite mating side 118. The shroud 30 includes a plurality of shroud openings 120 that extend through the mating side 118, through the base side 116, and completely through the shroud 30 therebetween. Each shroud opening 120 receives the mating segment 38 of a corresponding one of the electrical contacts 34. The shroud 30 may include any number of shroud openings 120 for any number of mating segments 38. The shroud 30 includes the latch arms 100 that cooperate with the latch tabs 98 of the base 26 to hold the shroud 30 on the base 26.

When the shroud 30 is mounted on the base 26, the base side 116 of the shroud 30 engages the shroud side 94 of the base 26 such that a portion of the shroud 30 extends outwardly from the shroud side 94 of the base 26. The mating segment 38 of each electrical contact 34 extends within a corresponding one of the shroud openings 120 of the shroud 30. Accordingly, portions of the shroud 30 extend around the mating segments 38. The latch arms 100 are engaged with the latch tabs 98 of the base 26 to hold the shroud 30 on the base 26.

Figure 12:
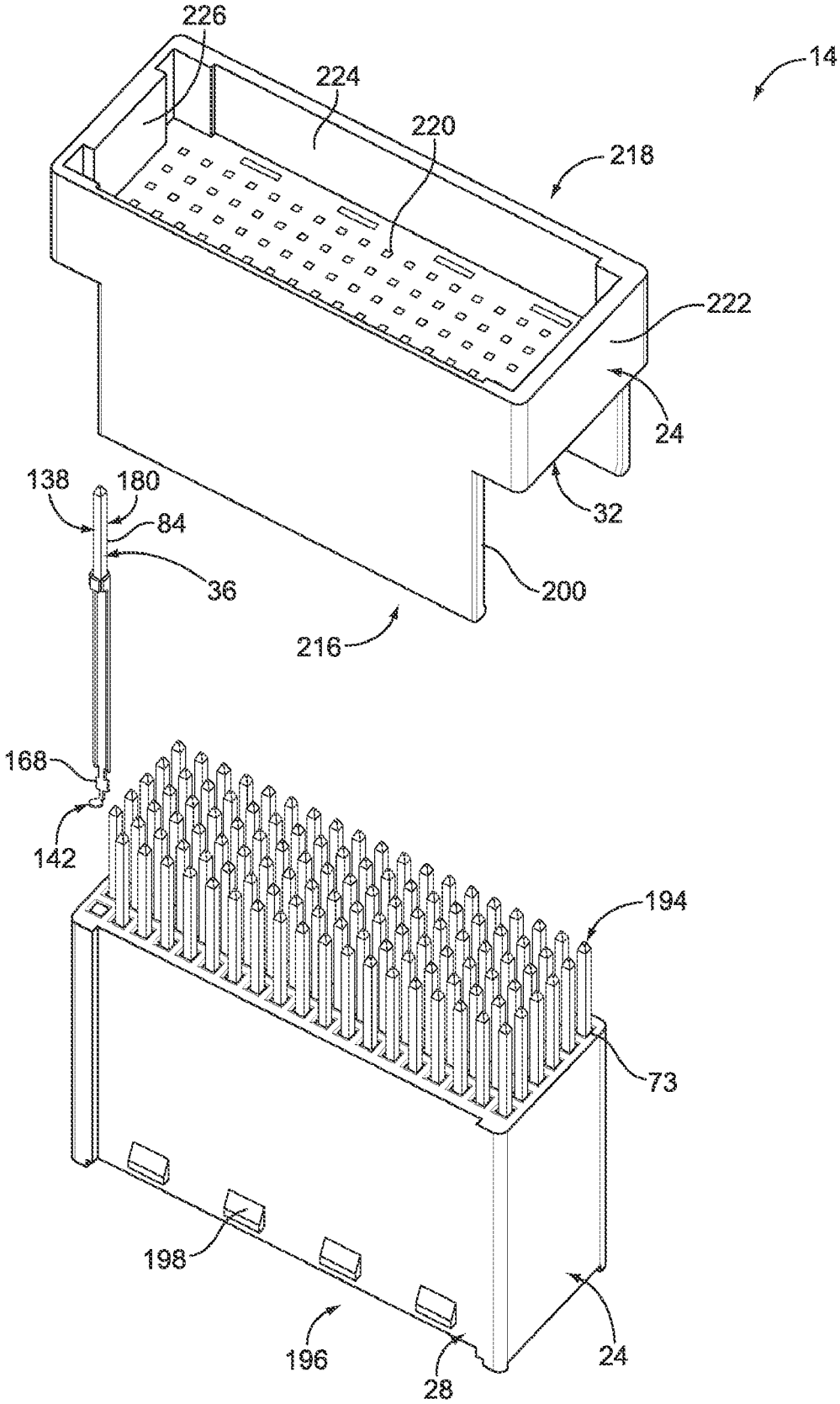
FIG. 12 is a partially exploded perspective view of an exemplary embodiment of the header connector shown in FIG. 1.

FIG. 12 is a partially exploded perspective view of an exemplary embodiment of the header connector 14. The header connector 14 includes the housing 24 and the electrical contacts 36. The housing 24 includes the base 28 and the shroud 32. The base 28 has a shroud side 194 and an opposite mounting side 196. The mounting side 196 of the base 28 is configured to be mounted on the printed circuit 18 (FIG. 1). The shroud 32 is mounted on the base 28 such that the shroud 32 extends outwardly from the shroud side 194 of the base 28. The base 28 includes latch tabs 198 that cooperate with latch arms 200 of the shroud 32 to hold the shroud 32 on the base 28.

The base 28 includes the plurality of contact openings 73 for holding the electrical contacts 36. The contact openings 73 extend through the shroud side 194, through the mounting side 196, and completely through the base 28 therebetween. Each contact opening 73 holds an electrical contact 36 of the header connector 14. The base 28 may include any number of contact openings 73 for holding any number of electrical contacts 36. Optional retention tabs 168 of the electrical contact 36 engage the base 28 within the corresponding contact opening 73 to hold the electrical contact 36 within the contact opening 73. When held in the contact openings 73, mating segments 138 of the electrical contacts 34 extend outward from the shroud side 194 of the base 28, while tail segments 142 extend outward from the mounting side 196 of the base 28 for engagement with the printed circuit 18 (FIG. 1). The mating segments 138 of the electrical contacts 36 include mating interfaces 180 that engage the mating interface 80 (FIG. 2) of a corresponding one of the electrical contacts 34 (FIGS. 1-3 and 10). The mating interface 180 of each electrical contact 36 includes the pin 84, which is configured to be engageably received within the socket 82 (FIG. 2) of the corresponding electrical contact 34. Alternatively, the mating segment 138 of one or more of the electrical contacts 36 includes any other structure for mating with the corresponding electrical contact 34, such as, but not limited to, a socket, a receptacle, an arm, and/or the like. Except for the mating segment 138, each electrical contact 36 is substantially similar to the electrical contacts 34 and therefore will not be described in more detail herein.

The shroud 32 includes a base side 216 and an opposite mating side 218. A peripheral wall 222 extends outwardly at the mating side 218. The wall 222 defines a receptacle 224 that receives the mating side 118 (FIG. 10) of the shroud 30 (FIGS. 1 and 10) of the receptacle connector 12 (FIGS. 1 and 10). The wall 222 includes an optional keying extension 226 that cooperates with a keying recess 228 (FIG. 10) extending within the shroud 30 of the receptacle connector 12, or vice versa. The shroud 32 includes a plurality of shroud openings 220 that extend through the mating side 218, through the base side 216, and completely through the shroud 32 therebetween. Each shroud opening 220 receives the mating segment 138 of a corresponding one of the electrical contacts 36. The shroud 32 may include any number of shroud openings 220 for any number of mating segments 138. The shroud 32 includes the latch arms 200 that cooperate with the latch tabs 198 of the base 28 to hold the shroud 32 on the base 28.

When the shroud 32 is mounted on the base 28, the base side 216 of the shroud 32 engages the shroud side 194 of the base 28 such that a portion of the shroud 32 extends outwardly from the shroud side 194 of the base 28. The mating segment 138 of each electrical contact 36 extends through a corresponding one of the shroud openings 220 of the shroud 32 and into the receptacle 224. Accordingly, the peripheral wall 222 of the shroud 32 extends around the mating segments 138. The latch arms 200 are engaged with the latch tabs 198 of the base 28 to hold the shroud 32 on the base 28.

As used herein, the term "printed circuit" is intended to mean any electric circuit in which the conducting connections have been printed or otherwise deposited in predetermined patterns on an electrically insulating substrate. Substrates 500 and 502 of the printed circuits 16 and 18, respectively, may each be a flexible substrate or a rigid substrate. Each of the substrates 500 and 502 may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate 500 and/or the substrate 502 is a rigid substrate fabricated from epoxy-glass, such that the respective printed circuit 16 and/or 18 is what is sometimes referred to as a "circuit board".

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "upper", "lower", "first", "second", "third," etc. are used merely as labels, and are not intended to impose numerical, orientational, and/or other requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for mounting on a printed circuit, said electrical connector comprising:

an electrical contact comprising a mating segment, an intermediate segment, and a tail segment, the mating segment comprising a mating interface configured to engage a mating contact of another connector, the tail segment comprising a mounting interface configured to be mounted to the printed circuit, the intermediate segment extending between and interconnecting the mating and tail segments, the intermediate segment comprising a base wall extending a length from the tail segment to the mating segment, the base wall extending a width from an edge to an opposite edge, the intermediate segment further comprising a side wall extending a length outwardly from the base wall along at least a portion of the length of the base wall, the length of the side wall being approximately half of the width of the base wall, the side wall extending outwardly at a non-parallel angle relative to the base wall for affecting at least one of an impedance, an insertion loss, or a reflection of the electrical contact; and a housing comprising a base and a shroud, the base comprising a shroud side, a mounting side, and a contact opening, the mounting side of the base being configured to be mounted on the printed circuit, the intermediate segment of the electrical contact being held by the base within the contact opening such that the mating segment extends outwardly from the shroud side of the base, the shroud extending outward from the shroud side of the base and around the mating segment of the electrical contact.

2. The electrical connector according to claim 1, wherein the side wall is a first side wall, the intermediate segment further comprising a second side wall extending outwardly from the base wall at a non-parallel angle relative to the base wall, a channel being defined between the base and side walls, the base wall defining a bottom boundary of the channel, the first and second side walls defining side boundaries of the channel.

3. The electrical contact according to claim 1, wherein the side wall is a first side wall, the intermediate segment further comprising a second side wall, the first and second side walls extending outwardly from the base wall at acute angles relative to the base wall and in directions generally toward each other.

4. The electrical connector according to claim 1, wherein the side wall extends outwardly at an oblique angle relative to the base wall.

5. The electrical connector according to claim 1, wherein a channel is defined between the base and side walls, a cross section of the channel taken approximately perpendicular to the length of the base wall comprises an L shape, a U shape, or a triangular shape.

6. The electrical connector according to claim 1, wherein the sidewall extends outwardly from one of the edges of the base wall.

7. The electrical connector according to claim 1, wherein the mating interface of the segment comprises one of:

a socket that is configured to receive a pin of the mating contact therein; or a pin that is configured to be received within a socket of the mating contact.

8. The electrical connector according to claim 1, wherein the mounting interface of the tail segment comprises a surface mount pad.

9. The electrical connector according to claim 1, wherein the electrical contact extends an overall length from an end of the mating segment to an end of the tail segment, the intermediate segment comprising at least half of the overall length of the electrical contact.

10. The electrical contact according to claim 1, wherein the side wall extends outwardly at an acute angle relative to the base wall.

11. The electrical connector according to claim 1, wherein at least one of a length of the side wall, an angle of the side wall relative to the base wall, or the number of side walls provided is selected to provide the electrical contact with at least one of a predetermined impedance, a predetermined insertion loss, or a predetermined reflection.

12. The electrical connector according to claim 1, wherein the shroud is a discrete component from the base that is mounted on the base.

13. An electrical connector for mounting on a printed circuit, said electrical connector comprising:

an electrical contact comprising a mating segment, an intermediate segment, and a tail segment, the electrical contact extending an overall length from an end of the mating segment to an end of the tail segment, the mating segment being configured to engage a mating contact of another connector, the tail segment being configured to engage the printed circuit, the intermediate segment extending between and interconnecting the mating and tail segments, the intermediate segment comprising at least half of the overall length of the electrical contact, the intermediate segment comprising a base wall extending a length from the tail segment to the mating segment, the intermediate segment further comprising a side wall extending outwardly from the base wall along at least a portion of the length of the base wall, the side wall extending outwardly at a non-parallel angle relative to the base wall for affecting at least one of an impedance, an insertion loss, or a reflection of the electrical contact; and a housing comprising a base and a shroud, the base comprising a shroud side, a mounting side, and a contact opening, the mounting side of the base being configured to be mounted on the printed circuit, the intermediate segment of the electrical contact being held by the base within the contact opening such that the mating segment extends outwardly from the shroud side of the base, the shroud extending outward from the shroud side of the base and around the mating segment of the electrical contact.

14. The electrical connector according to claim 13, wherein the side wall is a first side wall, the intermediate segment further comprising a second side wall extending outwardly from the base wall at a non-parallel angle relative to the base wall, a channel being defined between the base and side walls, the base wall defining a bottom boundary of the channel, the first and second side walls defining side boundaries of the channel.

15. The electrical connector according to claim 13, wherein the side wall is a first side wall, the intermediate segment further comprising a second side wall, the first and second side walls extending outwardly from the base wall at acute angles relative to the base wall and in directions generally toward each other.

16. The electrical connector according to claim 13, wherein the side wall extends outwardly at an oblique angle relative to the base wall.

17. The electrical connector according to claim 13, wherein the side wall extends outwardly at an acute angle relative to the base wall.

18. The electrical connector according to claim 13, wherein the base wall extends a width from an edge to an opposite edge, the side wall extending a length outwardly from the base wall, the length of the side wall being approximately half of the width of the base.

19. The electrical connector according to claim 13, wherein the shroud is a discrete component from the base that is mounted on the base.

20. The electrical connector according to claim 13, wherein at least one of a length of the side wall, an angle of the side wall relative to the base wall, or the number of side walls provided is selected to provide the electrical contact with at least one of a predetermined impedance, a predetermined insertion loss, or a predetermined reflection.

* * * * *